US007533530B2

(12) United States Patent
Courtright

(10) Patent No.: US 7,533,530 B2
(45) Date of Patent: May 19, 2009

(54) ENGINE FOR THE EFFICIENT PRODUCTION OF AN ENERGIZED FLUID

(76) Inventor: Geoffrey B. Courtright, 3209 Benicia Ct., Naples, FL (US) 34109

( * ) Notice: Subject to any disclaimer, the term of this patent is extended or adjusted under 35 U.S.C. 154(b) by 366 days.

(21) Appl. No.: 11/624,923

(22) Filed: Jan. 19, 2007

(65) Prior Publication Data

US 2008/0173018 A1 Jul. 24, 2008

(51) Int. Cl.
*F01K 13/02* (2006.01)

(52) U.S. Cl. ..... 60/660; 60/667; 60/670

(58) Field of Classification Search ..... 60/645, 60/660, 667, 670
See application file for complete search history.

(56) References Cited

U.S. PATENT DOCUMENTS

| | | | | |
|---|---|---|---|---|
| 1,282,482 | A | 10/1918 | Speals | |
| 2,122,676 | A | 7/1938 | Bourke | |
| 2,122,677 | A | 7/1938 | Bourke | |
| 2,242,871 | A | 5/1941 | Raab | |
| 2,404,651 | A | 7/1946 | Olin | |
| 2,516,325 | A | 7/1950 | Kasten | |
| 3,498,053 | A | 3/1970 | Johnston | |
| 3,517,652 | A | 6/1970 | Albertson | |
| 3,786,728 | A | 1/1974 | Sheesley | |
| 3,893,300 | A * | 7/1975 | Connell | 60/683 |
| 4,033,136 | A | 7/1977 | Stewart | |
| 4,042,311 | A | 8/1977 | Yonezawa | |
| 4,106,391 | A | 8/1978 | Wheeler | |
| 4,111,102 | A | 9/1978 | Harris | |
| 4,240,259 | A | 12/1980 | Vincent | |
| 5,010,852 | A | 4/1991 | Milisavljevic | |
| 5,050,482 | A | 9/1991 | Yonezawa | |
| 5,123,334 | A | 6/1992 | van Loo | |
| 5,456,076 | A | 10/1995 | Zornes | |
| 5,490,482 | A | 2/1996 | Genet | |
| 5,649,325 | A | 7/1997 | Garrison | |
| 5,673,560 | A | 10/1997 | Hope | |
| 6,016,773 | A | 1/2000 | Zinke | |
| 6,029,693 | A | 2/2000 | Nakanishi | |
| 6,210,149 | B1 | 4/2001 | Plavnik | |
| 6,321,775 | B1 | 11/2001 | Hildebrand | |
| 6,409,482 | B1 | 6/2002 | Fon | |
| 6,434,944 | B2 * | 8/2002 | White | 60/670 |
| 6,553,752 | B2 | 4/2003 | Anderson | |
| 6,584,759 | B1 | 7/2003 | Heap | |
| 6,745,876 | B2 | 6/2004 | Beck | |
| 6,752,064 | B2 | 6/2004 | Wheeler | |
| 6,779,334 | B2 | 8/2004 | Teacherson | |
| 6,804,963 | B1 * | 10/2004 | Tomoiu | 60/670 |
| 7,080,512 | B2 | 7/2006 | Schoell | |
| 7,080,517 | B2 | 7/2006 | Schlote | |
| 7,448,213 | B2 * | 11/2008 | Mitani | 60/616 |
| 2004/0009082 | A1 | 1/2004 | Wheeler | |
| 2005/0210879 | A1 | 9/2005 | Murayama | |
| 2005/0217268 | A1 | 10/2005 | Clawson | |

* cited by examiner

*Primary Examiner*—Hoang M Nguyen

(57) ABSTRACT

An engine comprising a detonation chamber in thermal communication with a tank, a fuel system connected to the chamber, and a controller wherein energy from fuel detonations in the chamber is transferred to a fluid in the tank. By rapidly transferring the energy from the chamber, the detonation produces little or no toxic by-products. The fluid in the tank is energized to provide power for a wide range of machines from large equipment to small appliances.

22 Claims, 3 Drawing Sheets

ENGINE FOR THE EFFICIENT PRODUCTION OF AN ENERGIZED FLUID

FIELD OF THE INVENTION

The present invention relates to a power generating system that generates an energized fluid, and more particularly to an engine with a control system for optimum production of energy to efficiently generate an energized fluid.

BACKGROUND OF THE INVENTION

An engine is a machine that converts energy into useful work that is used to power other machines, including everything from small appliances to generators and vehicles to heavy machinery. Engines work by extracting energy from fuels. Fuels are any materials that can be burned to release energy. Liquid fuels are commonly used to supply energy. Liquid fuels share certain attributes, such as hydrogen based compounds, including hydrogen and or hydrocarbons. The molecular structure and the amount of hydrocarbons in a liquid fuel affects its properties. For example, gasoline ignites more easily than diesel fuel because gasoline has a lower energy density and is therefore more volatile than diesel fuel; however, gasoline ignites at a higher temperature than diesel fuel because gasoline has a higher octane rating (octane measured relative to a mixture isomers to determine autoignition resistance). A low tendency to autoignite is desirable in a gasoline engine to avoid back firing. Using higher combustion temperatures in an engine results in a faster burn rate, producing more power from a smaller engine. Diesel fuel will, however, deliver more energy than gasoline if given sufficient time to burn because diesel fuel has a higher energy density than gasoline (the energy density of gasoline is about 31.60 MJ/L; diesel is about 35.5; gasoline contains about 150,000 BTU/gal; diesel about 170,000).

To control the burn of a fuel, fuels are typically ignited in a chamber that includes a fuel injector and an exhaust system and provides the ability to control pressure and temperature. A mixture of fuel and air containing oxygen will ignite when the concentration and temperature of reactants are sufficiently high. Alternately, an ignition source or a detonation device may be used to initiate combustion or to detonate the air/fuel mixture. A typical ignition device used in engines is an electrical charge, such as that produced by a spark plug.

A spark plug or other ignition device creates an electrical current that ignites the air/fuel mixture in the combustion chamber. An efficient burn is achieved through the use of proper timing of the spark, the proper heat range, and the appropriate voltage requirements for the given fuel.

After the fuel is ignited, it burns. Combustion is an incomplete burn of the fuel. Incomplete combustion occurs when too little oxygen is supplied for too little time for the fuel to burn completely. The fuel burns, but produces numerous by-products. For example, when a hydrocarbon burns completely, the reaction typically yields carbon dioxide and water. In incomplete combustion, the burn also produces numerous toxic by-products, such as carbon monoxide and nitrogen oxides. Incomplete combustion is a problem because these by-products can be quite unhealthy and damaging to the environment.

On the other hand, the complete burning a fuel—known as detonation—produces minimal by-products. Detonation burns the fuel to its basic components. Detonation is achieved through factors such as the provision of an optimum amount of air, optimum mixing of the air with the fuel, high initial temperatures, and proper design of the combustion chamber.

In existing engines, "complete" burning is usually not achieved; even "near complete" fuel burning typically yields minor amounts of by-products.

The burning of a highly caloric fuel generally results in an incomplete burn producing toxic by-products. To control these by-products, existing engines are made to deliberately drop the temperature and pressure in the chamber immediately after combustion starts but before detonation occurs to avoid the stress and heat produced by such a large amount of energy. Existing engines attempt to avoid detonation by exhausting the gases of combustion from the chamber while they are still burning. In so doing, toxic by-products have the potential to enter the environment. Due to pollution standards for motor vehicles in the United States and abroad, additional components, such as catalytic converters, must be added to the exhaust system to remove these toxic by-products.

The main reason for the deliberate release of energy is that standard internal combustion engines are not designed to handle the temperature and pressure necessary for complete detonation. Standard internal combustion, which is somewhat pressurized but not for a sufficient period of time to allow for a complete burn, is inefficient and requires elaborate heat exchangers and catalytic converters to capture lost heat and control pollution. Higher oxidized combustion coupled with elaborate heat exchangers, lubrication systems, cooling systems and the like, can provide energy with less pollution while maintaining a portion of the heat, but such a design increases the cost of the engine.

Not only does the cost of the engine increase because of the additional components, but the typical practice of releasing gases while the fuel is burning in existing engines is very inefficient. The amount of heat that is removed in a typical engine to avoid the production of toxic by-products can reduce the torque of an engine by over 100%. The inefficient deliberate loss of energy causes poor engine performance, so manufacturers resort to higher frequencies of ignitions to increase power. The increase in combustion events results in higher average heat transfer rates from the hot burned gases to the walls of the chamber. These higher temperatures cause thermal stress to a typical engine.

Timing of the introduction of the fuel, ignition, combustion or detonation, exhaust and reintroduction of the cycle are key factors in the efficiency of an engine. Ignition rates are typically based on the type of fuel and the amount of power needed. For example, the burn of a highly caloric fuel, which produces higher flame temperatures in combustion, requires more time between ignitions to decrease the temperature. Ignition rates increase upon the need for additional power and are low when the machine is at rest.

The pressure inside the chamber is in part a factor of ignition rates and exhaust rates. The greater the ignition rate, the higher the pressure in the chamber; the greater the exhaust rate, the lower the pressure in the chamber. Pressure is also related to temperature. As the temperature in the chamber drops, the pressure drops.

To obtain the optimum temperature and pressure necessary to minimize toxic by-products, sensors are added to monitor the fuel burning process. Pressure sensors measure pressure by comparing a reference to the level of charge flow associated with a specific level of pressure. Pressure is dependent upon atmospheric conditions and altitude. Temperature sensors typically used in fuel burning are any type of temperature sensor appropriate for sensing the temperature under such conditions.

In a machine, pressure and temperature sensors are generally used to feed data to a controller, such as a process logic controller (PLC), which in turn controls the pressure, temperature, ignition, and the like. A PLC is a computer designed for monitoring and controlling equipment by accepting signals from the sensors and other sources and applying the data to a set of instructions within its memory.

Many attempts have been made to provide low cost, efficient engines. One example is the steam engine, which uses a fuel to change the state of a liquid (typically, water, but other fluids may be used). Steam engines work by using the heat energy in the fuel to heat the liquid to a high-pressure steam state. When heat is transferred to a liquid, such as water, the water heats and boils and is eventually evaporated or vaporized. The pressure of water when heat is applied in a closed system increases in proportion to the temperature. When water in a sealed tank is heated, pressure builds up.

Water, however, resists vaporizing. Water has a high specific heat capacity and a high heat of vaporization due to the strong inter-molecular hydrogen bonds that must be broken during vaporization. A large amount of energy (about 41 kJ/mol) is required to evaporate water.

Existing engines suffer from the problem of not being able to efficiently generate a sufficient amount of energy to vaporize water without producing harmful by-products. U.S. Pat. No. 4,240,259 to Vincent ("Vincent") describes a boiler with an external combustion chamber that heats water in a pressure chamber to produce steam. Standard boiler combustion is essentially not pressurized and requires the recapture of heat. For continuous, highly oxidized combustion to be "clean burning" and "pollution free" as described in Vincent, the temperature of the burn must be kept artificially low to prevent nitrogen/oxygen toxic by-product formation. Vincent addresses the heat loss by recovering steam in a steam accumulator. The steam is re-pressurized and used again. Such a design, however increases the cost of the engine and decreases performance.

Another method of increasing the efficiency of the energy used to vaporize water is by using a heat sink to expose larger surface areas of water to the energy. A heat sink is a system capable of absorbing heat from an object with which it is in thermal contact without a phase change or a significant variation in temperature. Where heat is introduced to as much water surface area as possible, the pressure build up occurs more rapidly.

Insulating materials are another method of retaining heat in the creation of large amounts of energy. By using an insulator, energy is conserved to increase operational efficiency and reduce fuel costs. Selecting insulating materials usually depends upon heat resistance and cost. The insulation material can also be coated with a protective covering.

Currently, no low cost engine exists that efficiently burns a fuel without the production of toxic by-products. Accordingly, a need exists for an engine that is optimally designed to burn a fuel without additional components, such as catalytic converters and external re-pressurization devices. A need exists for a highly efficient, low cost engine that extracts energy from a fuel to create an energized fluid that can be used to do work.

SUMMARY OF THE INVENTION

The present invention comprises the cyclical controlled detonation of an oxidizer and fuel mixture in a chamber. The controlled detonation causes the complete oxidation of the fuel into its simplest components, thus eliminating fractional hydrocarbons. The present invention also provides for the rapid absorption of the energy by a second substrate, which quickly lowers the temperature of any by-products, thereby eliminating toxic by-products. The detonation process of the present invention creates very little, or no pollution and eliminates the need of additional components, such as cleaning or scrubbing devices, repressurizers, and the like.

In an embodiment, the engine comprises a detonation chamber in thermal communication with a tank, a fuel system connected to the chamber, and a controller. The chamber comprises a wall, a chamber sensor and a gauge. The chamber sensor measures a chamber pressure within the chamber and the gauge measures a temperature at the wall.

The tank is in contact with the wall and comprises a tank sensor, a tank inlet, and a tank outlet. The tank sensor measures a tank pressure within the tank. The tank inlet comprises a tank inlet valve. The tank outlet comprises a tank outlet valve. In an embodiment, the tank surrounds the chamber and the fluid is injected into the tank onto the wall. In an embodiment, the tank inlet and or the tank inlet valve comprises multiple fluid injectors. In an embodiment, fluid is injected into the tank by one or more than one fluid injector. In an embodiment, the wall is a heat sink. In an embodiment, the tank comprises at least one of an insulated outer wall and insulated inner wall.

The fuel system is interconnected to the chamber and comprises an oxidizer source, at least one fuel injector, and an exhaust. The fuel injector comprises at least one fuel receptacle. The oxidizer source comprises an oxidizer valve. The oxidizer source of the present invention is interconnected to an oxidizer holding compartment and a compressor. The exhaust comprises an exhaust valve. The exhaust is interconnected to the compressor. Upon detonation, the pressure in the chamber causes a portion of the detonation product to be directed to the compressor through the exhaust. The force of the exhausted detonation product operates the compressor to provide compressed oxidizer to the oxidizer holding compartment.

The controller determines a rate and an amount of at least one oxidizer and a rate and an amount of at least one fuel. The fuel injector comprises a fuel valve. The rates are derived from at least one of the temperature, chamber pressure, a requested amount of an energized fluid, and at least one property of the fuel and the oxidizer. The controller determines a detonation rate derived from at least one of the temperature, chamber pressure, requested amount of energized fluid, the property of the fuel, and the property of the oxidizer.

The controller controls the injection into the chamber from the fuel system of the determined amount of oxidizer at the determined oxidizer rate and the determined amount of fuel at the determined fuel rate. The oxidizer is any compound capable of reacting with and oxidizing a fuel. The controller controls the detonation of a mixture of the oxidizer and fuel in the chamber at the detonation rate. In an embodiment, a first fuel is detonated as a primer for a second fuel. In an embodiment, the fuel comprises any organic fluid. In an embodiment, the fuel comprises any liquid or gaseous hydrocarbon.

The mixture is detonated by a detonation device and or an increase in pressure. The detonation device comprises means to create a spark. The detonation produces an energy and at least one detonation product.

The controller controls the injection of a fluid into the tank. The fluid is any gas, liquid, or mixtures thereof. When the energy from the detonation transfers through the wall, the energy energizes the fluid. In an embodiment, the energy converts the fluid into an energized fluid. In an embodiment, the energy energizes an energized fluid. The timing and amount of the injection of the fluid is determined from the detonation rate. The controller determines the amount of pressure in the tank and controls the release of the energized fluid from the tank. The release is determined from the requested amount of energized fluid. In an embodiment, the energized fluid, upon a release of energy, is re-injected into the tank. The controller controls the release of the at least one detonation product from the chamber.

The process of the present invention comprises the steps of (a) selecting the fuel and the oxidizer; (b) sensing the temperature and the pressure in the chamber and the pressure in the tank; (c) determining the detonation rate based on at least one of the fuel type, the temperature and pressure in the chamber, the pressure in the tank, and the requested amount of energized fluid; (d) injecting an amount of fuel into the chamber, the amount of fuel is based on a fuel amount instruction derived from the detonation rate; (e) introducing a quantity of oxidizer into the chamber, the quantity of oxidizer is based on an oxidizer amount instruction derived from the detonation rate; (f) selectively detonating the oxidizer-fuel mixture based on a detonation instruction derived from the detonation rate, which creates an energy; (g) injecting a measure of fluid into the tank, the measure is based on a fluid measure instruction derived from the detonation rate; (h) energizing the fluid with the energy to convert the fluid to energized fluid in the tank; (i) exhausting all but a portion of detonation product based on a portion instruction derived from the detonation rate, the portion creates a detonation product pressure; (j) using the exhausted detonation product to drive a compressor, the compressor injects oxidizer into the oxidizer source; (k) selectively opening the outlet connected to the tank to release the energized fluid based on the requested amount of energized fluid; and (l) repeating steps b-k until there is no more request for power.

As used herein, "approximately" means within plus or minus 25% of the term it qualifies. The term "about" means between ½ and 2 times the term it qualifies.

The present invention is a low weight, low cost engine with few moving parts. The present invention offers high efficiency and optimal power for a wide range of machines from large equipment to small appliances. The present invention is an efficient, low-to-no pollution device that achieves a desired pressure for the burning of a given fuel by adjusting the frequency of fuel detonation and the speed with which the resulting heat is released from the detonation chamber. The energy extracted from the fuel is used directly to do work, or can be used to change the state of a solid or liquid, which in turn, may be stored or used to provide energy for powering one or more than one additional machine.

DETAILED DESCRIPTION OF THE INVENTION

Figure 1:
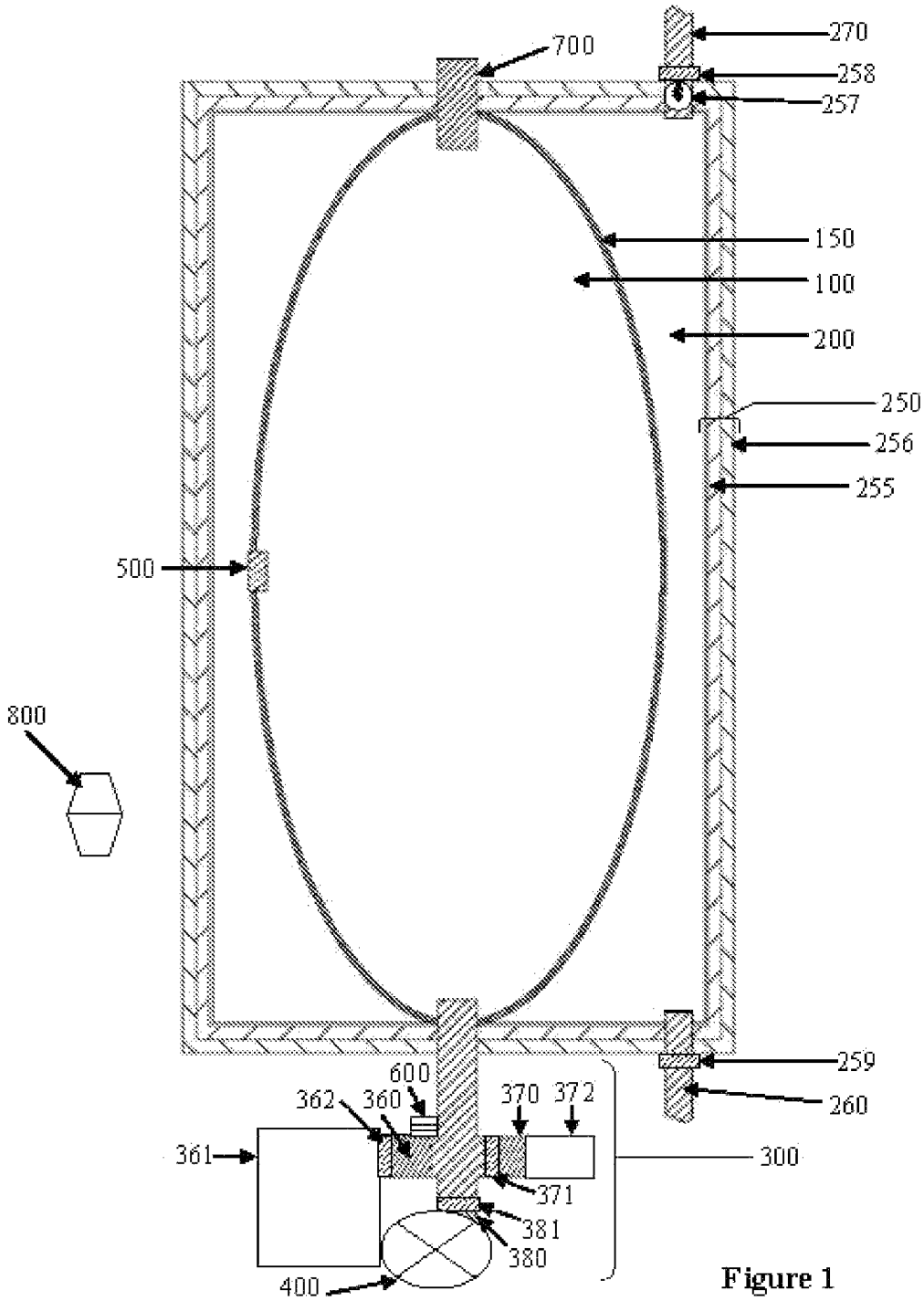
FIG. 1 is a cross-sectional view of an embodiment of the present invention.

As depicted in FIG. 1, the present invention comprises a detonation chamber 100. The detonation chamber 100 is a closed vessel designed to control the heat, pressure, and shock waves of repeated detonations. In an embodiment, the detonation chamber 100 is formed of a metal, preferably steel, but any material capable of withstanding repeated detonations and high heat may be used.

The chamber 100 is in contact with a tank 200. In an embodiment, the chamber 100 is immersed within the tank 200. In an embodiment, the tank 200 is formed of a metal, preferably steel, but any material capable of withstanding high heat may be used.

The detonation chamber 100 comprises a wall 150. In an embodiment, the wall 150 comprises the outer wall of the chamber 100 and is in contact with the tank 200. The surface area of the wall 150 is large, allowing for the rapid transfer of heat from the detonation chamber 100 to the tank 200. The wall 150 is shaped to allow optimum thermal contact between the chamber 100 and a fluid in the tank 200. In an embodiment, the wall 150 is a rounded shape.

In an embodiment, the wall 150 comprises a heat sink. In an embodiment, the wall 150 is a heat sink fabricated from a thermally conductive material, such as but not limited to aluminum, aluminum alloys, copper, copper alloys and conductive polymers, to provide high conductivity at a low weight and cost. In an embodiment, the wall 150 is a heat sink comprised of a base and a plurality of fins, pins and or folds. In an embodiment, the wall 150 is a combination of materials, such as but not limited to, aluminum and copper. The plurality of fins, pins or folds are generally vertically attached to the base to form a series of channels. One skilled in the art would understand that the wall 150 may be of any shape and design that allows for the rapid transfer of heat from the chamber 100 to the tank 200.

As depicted in FIG. 1, the tank 200 comprises at least one tank wall 250. The tank wall 250 defines the shape of the tank 200. In an embodiment, the tank 200 comprises more than one tank wall 250 such that the tank 200 is a closed form capable of containing a fluid. In an embodiment, the tank 200 comprises six tank walls 250 to form a cube, with the chamber 100 located within the cube. The tank wall 250 is designed to prevent heat loss from the tank 200.

The tank wall 250 may have insulation on the interior surface 255, the exterior surface 256, or both surfaces. In an embodiment, the tank wall 250 is composed of steel with internal insulation 255 and external insulation 256. The insulation 255, 256 may be any material, such as but not limited to: fiberglass, mineral wool, ceramics, ceramic fiber, cellular glass, cellular foam, polyethylene, polystyrene, calcium silicate, perlite and insulating cements. The insulation 255, 256 can also be coated with a protective covering, such as coatings of cement or mastics, reinforced paper, tar paper, canvass cloth, plastic, laminates, metals, and the like. This list is not restrictive, but merely to provide examples. The internal insulation 255 is designed to reflect the heat back into the tank 100. In an embodiment, the insulation 255, 256 is a ceramic. In an embodiment, the external insulation 256 is a ceramic blanket bonded with ceramic cement bond having a high temperature aluminum reflecting tape sealing the blanket. In an embodiment, the internal insulation 255 is a ceramic cement. In an embodiment, the internal insulation 255 is a waterproof, dense and highly insulating ceramic material bound to the inside of the tank wall 250 of the tank 200. One skilled in the art would readily understand that the tank wall 250 and the insulation 255, 256 could be composed of any suitable material and may include additional materials, coatings and the like. In an embodiment other components of the engine are insulated, such as but not limited to the tank outlet 270, the tank inlet 260, and the like.

Figure 4:
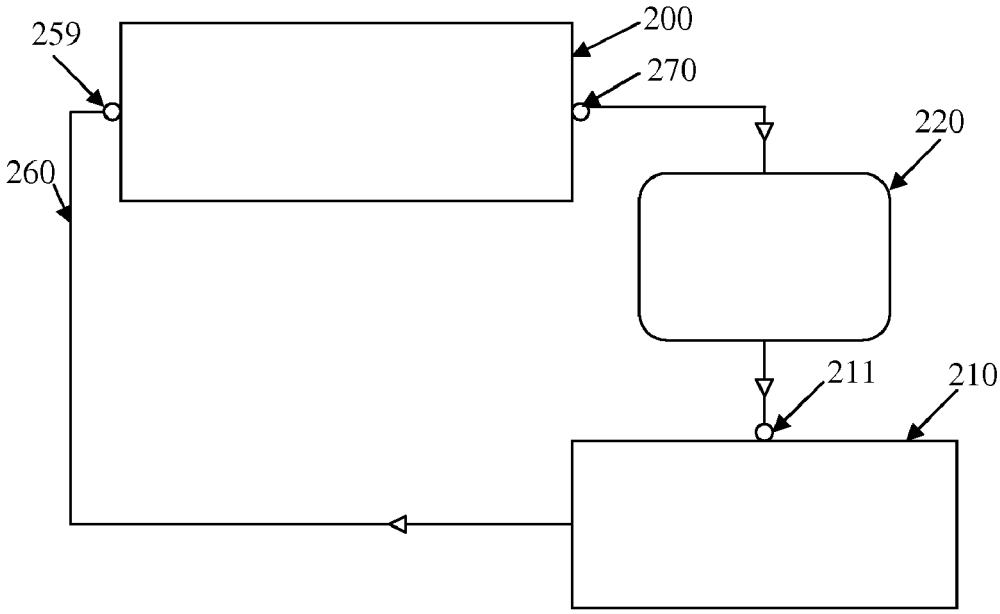
FIG. 4 is a schematic diagram of the flow of fluid in an embodiment.

As depicted in FIG. 4, the tank 200 comprises a tank inlet 260 and a tank outlet 270. The tank inlet 260 interconnects the tank 200 to a reservoir 210. In an embodiment, the present invention comprises multiple tank inlets 260. The tank outlet 270 interconnects the tank 200 to a machine 220 where energy from the energized fluid is extracted. In an embodiment, the energized fluid is introduced to more than one machine 220 in a series. In an embodiment, the energized fluid is introduced to more than one machine 220 at more or less the same time. In an embodiment, the energy from the energized fluid is stored. In an embodiment, the energized fluid is stored in one or more container. In an embodiment, the energized fluid is stored and then introduced into one or more machine. After use of all or a portion of the energy in the fluid by the machine 220, the fluid is returned to the reservoir 210 for reintroduction into the tank 200. Upon reintroduction to the tank 200, the fluid may be an energized fluid, in a normal state, or both.

Referring again to FIG. 1, the tank comprises a tank sensor 257. The tank sensor 257 determines a tank pressure within the tank 200. In an embodiment, the tank sensor 257 is an analog pressure gauge. In an embodiment, the tank sensor 257 is an electronic pressure gauge. In an embodiment, the tank sensor 257 is a digital pressure sensor. One skilled in the art would understand that the tank sensor 257 is any device that provides the ability for a user and or a machine to determine the tank pressure.

The tank 200 comprises a tank outlet valve 258. The tank outlet valve 258 is interconnected to the tank outlet 270. The tank outlet valve 258 operates to release energized fluid from the tank 200. The tank outlet valve 258 is closed as the fluid in the tank 200 is energized, and opened when a desired amount of pressure in the tank 200 is obtained. In an embodiment, the tank outlet valve 258 is a one-way valve that only allows energized fluid to exit the tank 200. In an embodiment, the tank outlet valve 258 is in communication with the tank sensor 257. In an embodiment, the tank outlet valve 258 is opened upon the tank sensor 257 reading a desired pressure.

The tank 200 comprises a tank inlet valve 259. The tank inlet valve 259 is interconnected to the tank inlet 260. The tank inlet valve 259 is opened to allow fluid to enter the tank 200. In an embodiment, the present invention comprises multiple tank inlet valves 259. The tank inlet valve 259 is closed when the desired amount of fluid is present in the tank 200. In an embodiment, the tank inlet valve 259 and tank inlet 260 comprise a fluid injector. The fluid injector sprays small droplets of fluid into the tank 200. In an embodiment, the injector directs the fluid to the wall 150. In an embodiment, the tank inlet valve 259 is a one-way valve that only allows fluid to enter the tank 200.

The fluid is any fluid that emits sufficient energy when undergoing a state change The fluid is any gas, liquid, or mixtures thereof. In an embodiment, the fluid comprises an organic fluid. In an embodiment, the fluid comprises a refrigerant, an antifreeze, mixtures thereof, and the like. In an embodiment, the fluid comprises water, haloalkanes, ammonia, alcohols, mixtures thereof, and the like. This list is not all inclusive but is merely representative of suitable fluids. In an embodiment, the fluid is water. In an embodiment, the fluid is a mixture of fluids, such as but not limited to a first fluid and a second fluid that serves as an antifreeze for the first fluid. In an embodiment, the first fluid is water and the second fluid is an alcohol.

The invention comprises a temperature gauge 500 at the wall 150 within the chamber 100. The gauge 500 may be analog or digital and is any type of temperature sensor appropriate for sensing the temperature under such conditions. The gauge 500 can be any type that can measure a temperature in the range from below about 0° F. to over about 1000° F.

The chamber 100 comprises a chamber pressure sensor 600. The chamber pressure sensor 600 compares the level of charge flow associated with a specific level of pressure to a reference. The chamber pressure sensor 600 may be a pressure sensor, such as a gauge sensor, a differential pressure sensor, and the like. The chamber pressure sensor 600 may be analog or digital. The pressure sensor 600 is any type instrument that can measure a pressure in the range of about 0 psi to about 1500 psi.

Figure 3:
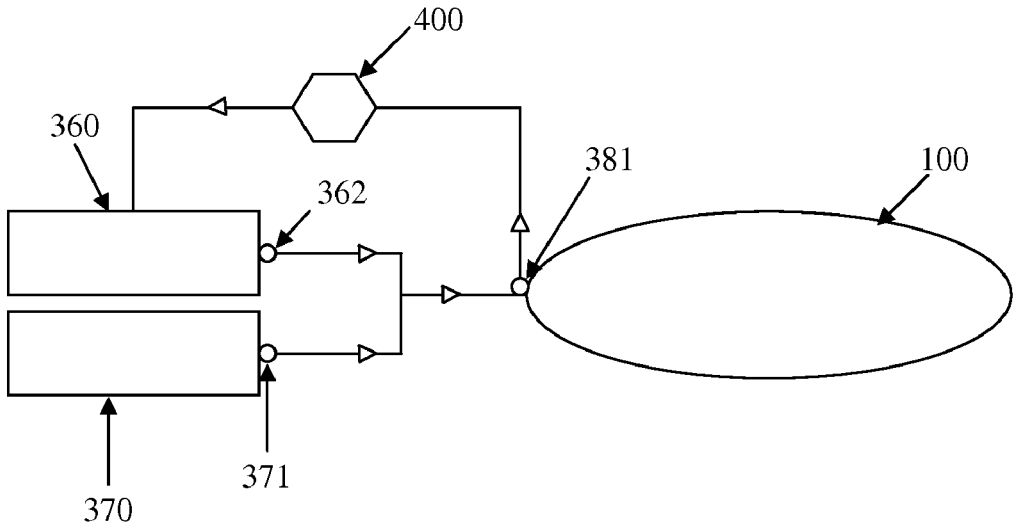
FIG. 3 is a schematic diagram showing the flow of oxidizer, fuel and detonation products in an embodiment.

As shown in FIG. 3, the present invention comprises a fuel system 300 interconnected to the chamber 100. The fuel system 300 comprises an oxidizer source 360, at least one fuel injector 370, and an exhaust 380. In an embodiment, the oxidizer source 360 is interconnected to an oxidizer holding compartment 361 and a compressor 400. In an embodiment, the oxidizer source 360 comprises an oxidizer valve 362. The oxidizer valve 362 operates to inject oxidizer into the chamber 100.

The oxidizer is any compound capable of reacting with and oxidizing a fuel. In an embodiment, the oxidizer of the present invention comprises at least one of a peroxide, nitrate, nitrite, perchlorate, chlorate, chlorite, hypochlorite, dichromate, permanganate, persulfate, mixtures thereof, and the like. In an embodiment, the oxidizer of the present invention comprises air, oxygen, hydrogen peroxide, mixtures thereof, and the like. This list is not all inclusive but is merely representative of suitable oxidizers.

The fuel injector 370 is designed to provide at least one fuel to the chamber 100. In an embodiment, the fuel injector comprises a fuel receptacle 372. In an embodiment, multiple fuel injectors 370 comprise multiple fuel receptacles 372. In an embodiment, the fuel injector 370 comprises a fuel injector valve 371. The fuel injector valve 371 operates to inject at least one fuel into the chamber 100. In an embodiment, the fuel system 300 is in communication with the chamber sensor 600 and the gauge 500. The exhaust 380 exhausts detonation products out of the chamber 100. The exhaust 380 comprises an exhaust valve 381. In an embodiment, the oxidizer valve 382, the fuel injector valve 371, and the exhaust valve 381 are one-way valves.

In an embodiment, the fuel system valves are controlled based upon the chamber sensor 600, the gauge 500, the oxidizer and fuel type, the fluid type and the requested amount of power. The request for power can be from a user or a machine or both. In an embodiment the request for power is for a greater amount of energized fluid.

The present invention is capable of using a wide range of fuels. In an embodiment, the fuel comprises any organic fluid. In embodiment, the fuel comprises any liquid or gaseous hydrocarbon. In an embodiment, the fuel comprises at least one of hydrogen, methane, propane, methanol, alcohol, butanol, natural gas, benzene, toluene, xylene, any petroleum oil, kerosene, gasoline, diesel, heating oil, biodiesel, ethanol, soybean oil, rapeseed oil, animal fat, microalgae oil, vegetable oil, mixtures thereof, and the like. This list is not all inclusive but is merely representative of suitable fuels. The present invention is capable of using a first fuel as a primer to increase the temperature to ignite a second fuel having a higher ignition temperature threshold. For example, a more volatile fuel, such as methane, is ignited to provide part of the energy required for the detonation of a fuel requiring a high temperature for ignition, such as heating oil.

In an embodiment, the present invention employs a low caloric fuel, such as but not limited to propane, methane, hydrogen and the like. By using a low caloric fuel, the fuel burns quickly at a relatively low temperature so that the temperature and the pressure in the chamber are kept at a lower rate during the burn. The heat from the detonation is quickly absorbed through the wall into the fluid, thus preventing the creation of toxic by-products.

Returning to FIG. 1, the invention comprises an ignition device 700 in communication with the chamber 100. The ignition device 700 can be any device that ignites a fuel. In an embodiment, the ignition device 700 is a spark plug. In an embodiment, the ignition device 700 is controlled by output from the chamber sensor 600, the gauge 500, the fuel and oxidizer type, and the requested amount of power.

The invention comprises a controller 800. In an embodiment, the controller 800 is a PLC. In an embodiment, the controller 800 is designed to operate under higher temperatures and is capable of operating during vibrations and jolts. The controller 800 comprises mechanical and process control, data detection, processing, manipulation and storage, communication, programming and updating capabilities, a user and or machine interface, and the like. The controller 800 is powered by an internal or external power source.

In an embodiment, the controller 800 is in communication with at least the fuel system 300, the ignition device 700, the tank inlet valve 259, the tank outlet valve 258, the chamber sensor 600, the gauge 500, and the tank sensor 257. The controller 800 monitors chamber 100 pressure and temperature via readings from the chamber sensor 600 and gauge 500 and controls the chamber pressure and temperature by operating at least the ignition device 700, the valves of the fuel system 300, and tank valves 259 and 258. Chamber pressure and temperature are also dependent upon the type of fuel(s), oxidizer(s) and fluid(s) used in the invention. The controller 800 operates by receiving data from the components of the invention and applying the input to a set of instructions within its memory. The controller 800 determines the rate and amount of oxidizer(s) and the rate and amount of fuel(s) to be injected into the chamber 100 based on at least one of the temperature, pressure, at least one property of the fuel, oxidizer and fluid, and an amount of power requested.

The controller 800 controls the fuel system 300 and the ignition device 700 so that the determined amount of oxidizer at the determined oxidizer rate and the determined amount of fuel at the determined fuel rate is injected into the chamber 100 at the optimal time to be ignited by the ignition device 700. The controller 800 controls the timing and amount of fluid injected into the tank 200. The controller controls the timing and amount of energized fluid exiting the tank 200. The controller 800 controls the amount and time of the exhausting of exhaust products. The controller 800 continually adjusts instructions to the fuel system 300, the ignition device 700, the tank inlet valve 259, and outlet valve 270 in response to input, such as fuel, oxidizer, and fluid type, pressure readings, temperatures and a request for power by the machine or the user. In an embodiment, the controller is linked to a control of one or more machine. In an embodiment, the controller is linked to one or more second controller.

Process

Figure 2:
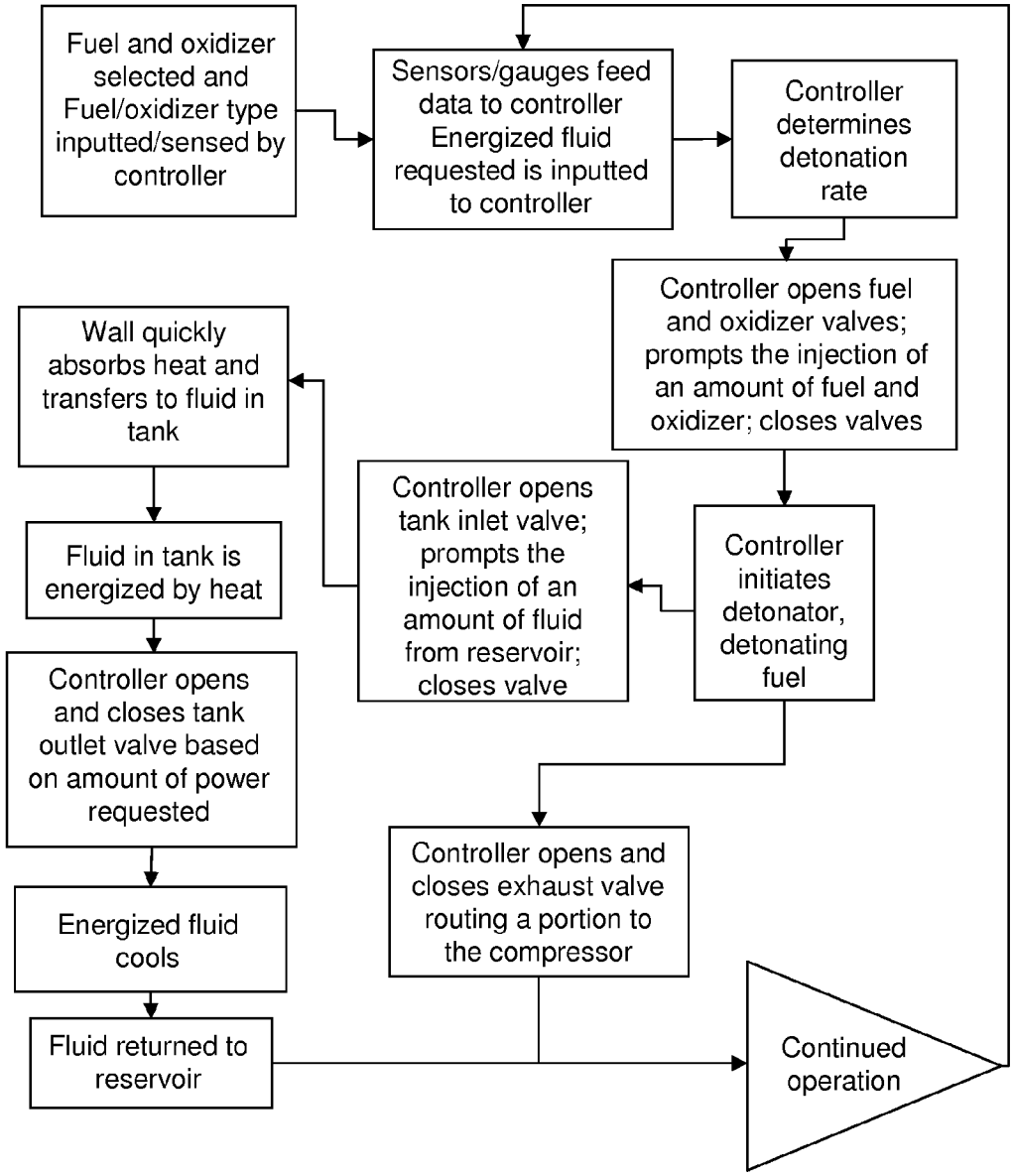
FIG. 2 is a flow diagram illustrating a method of operating the engine of FIG. 1.

FIG. 2 is a graphic depiction of the process of an embodiment of the present invention. As shown in FIG. 2, a fuel and oxidizer are selected. In an embodiment, the present invention is pre-programmed for a given fuel and oxidizer. In an embodiment, a switch, toggle or knob is used to input the fuel and or oxidizer types into the controller. In an embodiment, the fuel and oxidizer are selected from an interaction with the controller, such as but not limited to a pull down list of options stored in the memory of the controller. In an embodiment, the present invention comprises an override switch to select the fuel and or the oxidizer.

The engine is initiated with a positive request for power. The positive request for power can be from a user, a machine, or a combination of the user and the machine. The request can be a user and or machine performing a mechanical function, such as turning a dial, pushing a button, moving a lever, and the like, that is translated to the controller, or the request can be a user and or machine directly providing a command to the controller. The positive request for power can be for a variety of functions, such as but not limited to, torque, thrust, acceleration, and the like.

During operation of the engine, a variety sensors, gauges, and other devices are in communication with the controller. When a request for power is received by the controller, the controller applies data received from the chamber sensor and the gauge to the designated fuel and oxidizer and determines a detonation rate based on the energy produced from prior detonations and the current power request. In an embodiment, the detonation rate is the fastest possible cycle that detonation will occur for the injected volumes of oxidizer and fuel.

FIG. 3 is a diagram showing the fuel system 300 in operation. Based on the detonation rate, the controller 800 opens the fuel injector valve 371 to inject a calculated amount of fuel from the fuel injector 370 and opens the oxidizer valve 362 to inject a calculated amount of oxidizer from the oxidizer source 360. The controller modifies the amount of oxidizer-fuel mixture introduced into the chamber based on an increase or decrease in the energy released. The controller varies the oxidizer and fuel amounts to determine the optimum mixture based on conditions, such as but not limited to altitude, which effects pressure.

In an embodiment, the present invention comprises more than one fuel injector 370. In an embodiment, a first fuel injector is used to provide a fuel, such as methane, diesel, and the like, to the chamber 100. The first fuel is mixed with an oxidizer and ignited, whereupon a second fuel injector provides a second fuel such as heating oil, gasoline, and the like, to the chamber 100 where it is mixed with an oxidizer and detonated using the energy from the detonated first fuel to provide a higher temperature for the detonation.

Returning to FIG. 2, the controller closes the valves of the fuel system and activates the ignition device 700 to detonate the oxidizer-fuel mixture in the chamber. The controller causes the ignition device to pulse such that a spark is supplied to the chamber at the moment that the oxidizer-fuel mixture is optimal. The optimal ignition timing is further established using pressure and temperature data as compared to the energy produced and the level of power requested. The controller includes the ability to map pressure in the chamber to determine peak pressure and temperature for every detonation based on the amount of power requested. In an embodiment, when a positive power request is received, the rate of detonation increases to the fastest possible rate for that oxidizer-fuel mixture until the power demand is met.

The detonation is an almost instantaneous high-pressure release of heat. Efficiency in the present invention is achieved by detonating an over-oxidized fuel mixture under a determined pressure for a sufficiently long enough period of time to completely consume all of the fuel. Upon detonation, the temperature and pressure in the chamber increase. In an embodiment, the temperature spikes to about 1000° F. and the pressure spikes to about 1400 psi. The temperature and pressure then decrease within a fraction of a second through the heat being absorbed through the wall 150.

In an embodiment, the wall 150 is a heat sink. In an embodiment, the chamber is enclosed in the tank and the heat sink is the interface between the enclosed chamber and the fluid in the tank. By being surrounded by a fluid, the detonation in the chamber provides very little noise. The heat sink transfers the heat produced by the detonation to the lower temperature fluid in the tank. In an embodiment, heat is conducted from the chamber through the heat sink base and then to the heat sink fins where it is immediately dissipated by thermal transfer to the fluid. The drop in temperature in the chamber also produces an immediate drop in the pressure in the chamber.

FIG. 4 depicts a diagram of the fluid flow. Based on the timing of the fuel and oxidizer injections into the chamber and the ignition, the controller activates the production of energy in a fluid. In an embodiment, an amount of fluid is injected into the tank 200 via the tank inlet 260 through the tank inlet valve 259. In an embodiment, the fluid is delivered directly to the wall 150. After the tank inlet valve 259 is closed, the energy at the wall 150 energizes the fluid to an energized fluid in the tank 200. The energized fluid leaves the tank 200 through the tank outlet 270 upon the opening of the tank outlet valve 258. Flow, or the amount of energized fluid emitted per minute from the tank, is determined by factors such as the size of the chamber and tank, the fluid used, the frequency of detonations, and the like. Energized fluid production is also related to the type of fuel used (based on the fuel's detonation temperature, which produces a given calories per unit).

The tank outlet 270 is connected to at least one machine 220. In an embodiment, the machine 220 includes, or is, one or more storage tank equipped to store a pressurized gas. As the machine 220 uses the energy in the energized fluid, the energized fluid is routed to a reservoir 210, which has a reservoir valve 211. The fluid in the reservoir 210 is re-injected into the tank 200. In an embodiment, the fluid system is closed. In an embodiment, the fluid system includes means to add one or more fluid to the system.

Referring again to FIG. 2, when power is requested, the rate of detonation increases. When the demand stops, the rate of detonation stops. The length of time between detonations ranges from a fraction of a second to a complete stop of the engine. In an embodiment, the present invention is a device useful for the detonation of a low caloric fuel. During detonation, the fuel burns quickly producing lower temperatures than higher calorie fuels. By cooling the chamber rapidly after detonation, the detonation of the fuel produces only water and carbon dioxide. The products of detonation are not hot enough for a long enough time for radical oxygen or radical nitrogen atoms to form any nitrogen/oxygen toxic combinations. Any water in the chamber is vaporized upon detonation, but quickly reforms into water molecules as the temperature drops. As the water molecules interact with other water molecules, droplets form. The reversion of the vaporized water to a fluid in the chamber consumes energy, aiding in the cooling of the chamber. The resulting pressure in the chamber is only slightly greater than the pressure before detonation.

Referring back to FIG. 3, after detonation the controller opens and closes the exhaust valve 381 to emit an amount of detonation products. The controller modifies the amount of detonation products retained in the chamber to provide the optimum pressure for the next detonation. The controller times the releases of the exhaust products from the chamber to avoid heat loss. The controller times the detonations to allow a portion of the detonation products to be exhausted and the next oxidizer-fuel mixture to enter the chamber.

The controller determines the optimum pressure in the chamber based on the request for power and releases exhaust products prior to the subsequent injection of oxidizer and fuel. Because the pressure in the chamber is increased by detonation products after detonation occurs, the exhaust process is extended as long as possible to provide optimal conditions for the next detonation. In an embodiment, the controller injects oxidizer prior to closing the exhaust valve to assist the exhaust process. In an embodiment, the exhausting of the detonation products is varied to allow a larger amount of detonation products to remain in the chamber, such as in response to a demand for a large amount of power. Because the higher concentration of detonation products causes inefficient operation of the engine, the controller increases the detonation rate.

In an embodiment, the controller is programmed to limit the detonation rate. Limiting the detonation rate controls the diminishing returns on power over efficiency. In such cases, more than one of the present invention can be used to provide the requested amount of power.

As depicted in FIG. 3, the controller emits detonation products through the exhaust valve 381 to power the compressor 400. In an embodiment, the compressor 400 compresses outside air which flows to an oxidizer holding compartment for use as an oxidizer. In an embodiment, other types of oxidizers, such as but not limited to oxygen, hydrogen peroxide, and the like are provided to the oxidizer holding compartment.

The present invention continues the detonation of the fuel at the detonation rate as adjusted based on changes in the request for power and other data received from the components of the engine. The detonation rate drops upon a negative request for power. When the detonation rate equals zero, the controller stops the injection of fuel and oxidizer. When the user or the machine no longer requests power, the process is terminated, and the engine stops.

EXAMPLE

As illustration of the process of the invention, and not to limit the disclosure, the following example is provided:

In an embodiment, propane is used as a fuel and air is used as an oxidizer. A user inputs "propane" and "air" into the PLC. The PLC uploads data from the gauge to establish a chamber temperature value and data from the chamber sensor to establish a chamber pressure value within the PLC. The PLC receives a request for power. In this example, the request for power is a second machine that provides thrust. The PLC calculates a detonation rate based on the properties listed in its memory for propane and air, the chamber temperature and pressure, and the amount of thrust requested.

The PLC directs the fuel injector to inject an initial amount of approximately 40 cu. in. of propane at approximately 30 psi into the chamber through the fuel valve. The PLC opens the oxidizer valve to introduce an initial quantity of about 400 cu. in. of air at 60 psi into the chamber from a compressed air storage tank. The valves close and the air-fuel mixture is contained within the chamber. After a mixing time determined from the detonation rate, the PLC activates a spark plug to provide a spark within the chamber that detonates the air-fuel mixture. The detonation creates a wave of heat that immediately expands to the wall of the chamber.

In this example, the wall is a heat sink with a first side forming the interior of the chamber and an opposite side positioned in a tank that surrounds the chamber. In an embodiment, the wall is a heat sink with the base of the heat sink forming the interior of the chamber and the fins on the opposite side of the heat sink extending into a tank that surrounds the chamber. Based on the detonation rate, the PLC directs an injector connected to a tank to spray an amount of water in droplet form onto the fins. The valves to the tank are closed. The water droplets are immediately vaporized to steam upon contact with the fins and the pressure builds in the tank.

The consumption of the energy from the detonation by the water instantly drops the temperature and pressure in the chamber. Based on the detonation rate, the PLC opens the exhaust valve for a determined amount of time and the remaining pressure in the chamber exhausts a portion of the products of the detonation to drive a compressor that compresses fresh air into a storage tank.

Based on the thrust request, the PLC opens the tank outlet and the steam jets from the tank at a temperature in the range from about 225° F. to about 300° F. and at a pressure of about 200 psi to about 500 psi depending on the request for power. The tank outlet directs the pressurized steam to the machine to provide power. Upon use by the machine, the steam cools and is routed to a reservoir that is connected to the water injector for reintroduction into the tank when directed by the PLC. In an embodiment, at least one of cooled steam and water are reintroduced into the tank. In an embodiment, the water includes an antifreeze compound.

After detonation, the PLC resets the PLC chamber temperature and pressure based on input from the chamber sensor and gauge, applies any change in the request for thrust, and recalculates the detonation rate. In an embodiment, the detonation rate maintains the wall at an optimal running temperature. In an embodiment, the running temperature is from about 350° F. to about 400° F. One skilled in the art would understand that the wall temperature varies based on factors such as but not limited to the type of fuel(s), the type of oxidizer(s), the type of fluid(s), the construction of the chamber the tank and the wall, the demand for power, and the like. Based on the current detonation rate, the PLC initiates the process for subsequent detonations. In this example, the PLC samples and calculates at given intervals and adjusts the detonation rates accordingly.

In an embodiment, more than one of the present invention are used to produce power. In an embodiment, one or multiple chambers produce energized fluid in one joint tank or in individual tanks coupled to each engine. In an embodiment, each energized fluid outlet is connected to more than one machine and or more than one storage tank. In an embodiment, multiple outlets are connected to one machine and or one storage tank. In an embodiment, the energized fluid is compressed in a storage tank. In an embodiment, the present invention is combined with other systems, such as other types of engines and or machines. In an embodiment, the controller directs the energized fluid to drive a compressor that compresses air into a storage tank that can used by a machine that uses compressed air. In an embodiment, the controller directs the energized fluid to drive a compressor that compresses oxidizer in an oxidizer storage compartment. In an embodiment, the present invention is used to power individual components of a machine at the same or at different times. For example, the present invention can be used to provide energized fluid in response to requests for power, but when no requests are received by the controller, the controller directs the energized fluid to drive a compressor that compresses an oxidizer and or a second gas into a separate storage tank. In an embodiment, the second gas comprises natural gas, methane, propane and the like and is stored in a fuel reservoir.

The foregoing descriptions of specific embodiments and examples of the present invention have been presented for purposes of illustration and description. They are not intended to be exhaustive or to limit the invention to the precise forms disclosed, and obviously many modifications and variations are possible in light of the above teachings. It will be understood that the invention is intended to cover alternatives, modifications and equivalents. The embodiments were chosen and described in order to best explain the principles of the invention and its practical application, to thereby enable others skilled in the art to best utilize the invention and various embodiments with various modifications as are suited to the particular use contemplated. It is therefore to be understood that within the scope of the appended claims, the invention may be practiced otherwise than as specifically described herein.

I claim:

1. An engine comprising:

a detonation chamber, said chamber comprising a wall, a chamber sensor and a gauge, said chamber sensor measuring a chamber pressure within the chamber, said gauge measuring a temperature at the wall;

a tank, said tank in contact with the wall and comprising a tank sensor, a tank inlet, and a tank outlet, said tank sensor measuring a tank pressure within the tank, said tank inlet comprising a tank inlet valve, said tank outlet comprising a tank outlet valve;

a fuel system interconnected to the chamber comprising an oxidizer source, at least one fuel injector interconnected to at least one fuel reservoir, and an exhaust, said oxidizer source comprising an oxidizer valve, said fuel injector comprising a fuel valve, said exhaust comprising an exhaust valve; and a controller, said controller:

(a) determining a rate and an amount of at least one oxidizer and a rate and an amount of at least one fuel, said rates derived from at least one of the temperature, chamber pressure, a requested amount of an energized fluid, and at least one property of the fuel and the oxidizer;

(b) determining a detonation rate derived from at least one of the temperature, chamber pressure, requested amount of energized fluid, the property of the fuel, and the property of the oxidizer;

(c) controlling the injection into the chamber from the fuel system of the determined amount of oxidizer at the determined oxidizer rate and the determined amount of fuel at the determined fuel rate;

(d) controlling the detonation of a mixture of the oxidizer and fuel in the chamber at the detonation rate, wherein the detonation produces an energy and at least one detonation product;

(e) controlling the injection of a fluid into the tank, wherein the energy transfers through the wall to the fluid converting the fluid into energized fluid, said injection determined from the detonation rate;

(f) determining the amount of tank pressure in the tank and controlling the release of the energized fluid from the tank; said release determined from the tank pressure and the requested amount of energized fluid; and (g) controlling the release of a portion of the detonation product from the chamber.

2. The engine of claim 1 wherein the oxidizer source is interconnected to at least one oxidizer holding compartment and a compressor and the exhaust is interconnected to the compressor.

3. The engine of claim 2 wherein the portion of the detonation product is directed to the compressor; said detonation product providing a force that operates the compressor, said compressor providing compressed oxidizer to the oxidizer holding compartment.

4. The engine of claim 1 wherein the detonation of the mixture comprises at least one of a detonation device and an increase in chamber pressure.

5. The engine of claim 4 wherein the mixture is detonated by an increase in chamber pressure and a spark.

6. The engine of claim 1 wherein the energy energizes an energized fluid.

7. The engine of claim 1 wherein at least one first fuel is detonated as a primer for at least one second fuel.

8. The engine of claim 1 wherein at least one of the tank inlet and the tank inlet valve comprise a multiple fluid injector.

9. The engine of claim 1 wherein the tank surrounds the chamber and the fluid is injected into the tank onto a side of the wall facing the tank.

10. The engine of claim 9 wherein the fluid is injected into the tank onto the wall through multiple fluid injectors.

11. The engine of claim 1 wherein the wall is a heat sink.

12. The engine of claim 1 wherein the tank comprises at least one of an insulated outer wall and insulated inner wall.

13. The engine of claim 1 wherein the energized fluid, upon an extraction of at least a portion of the energy, is re-injected into the tank.

14. A process using the engine of claim 1 to provide power comprising:

(a) selecting the fuel and the oxidizer;

(b) sensing the temperature and the pressure in the chamber and the pressure in the tank;

(c) determining the detonation rate based on at least one property of the fuel, one property of the oxidizer, the temperature and pressure in the chamber, the pressure in the tank, and the requested amount of energized fluid;

(d) injecting an amount of fuel into the chamber; said amount of fuel based on a fuel amount instruction derived from the detonation rate;

(e) introducing a quantity of oxidizer into the chamber, said quantity based on an oxidizer amount instruction derived from the detonation rate;

(f) selectively detonating the oxidizer-fuel mixture based on a detonation instruction derived from the detonation rate to create the energy;

(g) injecting a measure of fluid into the tank, said measure based on a fluid measure instruction derived from the detonation rate;

(h) energizing the fluid with the energy to convert the fluid to energized fluid in the tank;

(i) exhausting all but a portion of detonation product based on a portion instruction derived from the detonation rate, said portion creating a detonation product pressure;

(j) using the exhausted detonation product to drive a compressor, said compressor injecting oxidizer into the oxidizer source;

(k) selectively opening the outlet connected to the tank to release the energized fluid based on the requested amount of energized fluid; and (l) repeating steps b-k.

15. The process of claim 14 wherein the step of selecting the fuel and the oxidizer comprises selecting at least one fuel and at least one oxidizer.

16. The process of claim 14 wherein at least one first fuel is detonated as a primer for at least one second fuel.

17. The process of claim 14 wherein the step of energizing energizes an energized fluid.

18. The process of claim 14 wherein the energized fluid is provided to one of at least one machine and at least one storage vessel.

19. The engine of claim 14 wherein the energized fluid provides power to at least one of the compressor and a second compressor.

20. A multi-engine comprising more than one of the engine of claim 1.

21. The multi-engine of claim 20 wherein the energized fluid is provided to one of at least one machine and at least one storage vessel.

22. The engine of claim 20 wherein the energized fluid provides power to a second compressor, said second compressor compressing a second fuel into a fuel storage tank.

* * * * *